US006550102B1

(12) United States Patent
Liang

(10) Patent No.: US 6,550,102 B1
(45) Date of Patent: Apr. 22, 2003

(54) HANDLE UNIT FOR A RETRACTABLE HANDLE ASSEMBLY OF A LUGGAGE CASE

(76) Inventor: Sung-Ming Liang, No. 21, Lane 169, Fu-Shan St., Chang-Hua City (TW)

( * ) Notice: Subject to any disclaimer, the term of this patent is extended or adjusted under 35 U.S.C. 154(b) by 8 days.

(21) Appl. No.: 10/011,532

(22) Filed: Nov. 5, 2001

(51) Int. Cl.[7] ..... A45C 7/00; A45C 13/22

(52) U.S. Cl. ..... 16/113.1; 190/115; 190/18 A; 280/655; 280/655.1

(58) Field of Search ..... 16/113.1; 190/115, 190/18 A; 280/655, 655.1, 47.315, 47.371

(56) References Cited

U.S. PATENT DOCUMENTS 5,530,990 A * 7/1996 Chen ..... 16/113.1
5,781,965 A * 7/1998 Lu ..... 16/113.1
6,061,871 A * 5/2000 Wang ..... 16/113.1
6,122,800 A * 9/2000 Cheng ..... 16/113.1
6,226,834 B1 5/2001 Lu ..... 16/113.1
6,332,242 B1 * 12/2001 Chen ..... 16/113.1
6,450,308 B1 * 9/2002 Kuo ..... 190/115
6,470,529 B1 * 10/2002 Chang ..... 16/113.1

* cited by examiner

*Primary Examiner*—Chuck Y. Mah
(74) *Attorney, Agent, or Firm*—Christie, Parker & Hale, LLP

(57) ABSTRACT

A handle unit includes an upper cap member, a press member, a base member, two biasing members, and first and second screw fasteners. The upper cap member has an upper wall formed with two hollow posts, a surrounding wall that cooperates with the upper wall to form a receiving chamber, and opposite ends formed with screw holes. The press member is disposed in the receiving chamber. The base member is formed with second and third through holes, and two openings. The biasing members are sleeved on the hollow posts, and have upper and lower ends abutting against the press member and the base member, respectively. Each of the first and second screw fasteners extends through a respective one of the second and third through holes, and engages a respective one of the hollow posts and the screw holes.

5 Claims, 6 Drawing Sheets

HANDLE UNIT FOR A RETRACTABLE HANDLE ASSEMBLY OF A LUGGAGE CASE

BACKGROUND OF THE INVENTION

1. Field of the Invention

The invention relates to a handle unit, more particularly to a handle unit for a retractable handle assembly of a luggage case.

2. Description of the Related Art

FIGS. 1 and 2 illustrate a conventional handle structure for a luggage according to U.S. Pat. No. 6,226,834. The conventional handle structure comprises a handle unit 1, two inner tubes 3, two linking rods 2, two locking devices 4, and two outer tubes 5. The handle unit 1 comprises an upper cap 101, a press plate 102, and a base 103.

During assembly of the conventional handle unit 1, a high degree of precision is needed to slide insertion blocks 1031 on the base 103 accurately into cut slots 1013 in the upper cap 101 so as to mount the upper cap 101 on the base 103. Furthermore, since a spring 1024 is received in a chamber 1023 at the mediate portion of the press plate 102 and has one end attached to a stub 1035 on the base 103, when the spring 1024 pushes the press plate 102 upwardly to restore the latter to a normal position, the restoring force of the spring 1024 will be centered on the mediate portion of the press plate 102, thereby leading to non-balanced action at opposite ends of the latter.

SUMMARY OF THE INVENTION

Therefore, the main object of the present invention is to provide a handle unit for a retractable handle assembly of a luggage case that is capable of overcoming the aforementioned drawbacks of the prior art.

Accordingly, a handle unit of the present invention is adapted for use in a retractable handle assembly of a luggage case. The handle unit comprises an elongate upper cap member, an elongate press member, an elongate base member, a pair of biasing members, a pair of first screw fasteners, and a pair of second screw fasteners. The elongate upper cap member has an upper wall that extends in a longitudinal direction, and a surrounding wall that extends from a periphery of the upper wall in a transverse direction transverse to the longitudinal direction. The surrounding wall cooperates with the upper wall to form a downwardly opening receiving chamber. The upper wall is formed with a cutout and a pair of downwardly extending hollow posts that are disposed at opposite sides of the cutout. The hollow posts are spaced apart from each other in the longitudinal direction, and are threaded internally. The upper cap member further has opposite longitudinal ends formed with a respective screw hole that opens downwardly. The surrounding wall has a connecting end connected to the upper wall, a distal lower end face opposite to the connecting end in the transverse direction, and an inner wall surface that is disposed between the connecting end and the distal lower end face. The inner wall surface is formed with a protrusion that protrudes into the receiving chamber. The elongate press member is disposed in the receiving chamber, and is formed with a pair of first through holes and a pair of link actuating ends. Each of the first through holes permits the hollow posts to extend slidably and respectively therethrough. Each of the link actuating ends extends toward a respective longitudinal end of the upper cap member. The elongate base member is formed with a pair of second through holes, a pair of third through holes, and a pair of openings. The second through holes are registered respectively with the hollow posts. The third through holes are registered respectively with the screw holes. The openings extend in the transverse direction and permit access to the link actuating ends, respectively. The base member has an upper peripheral part with a distal upper end face, and a peripheral shoulder disposed around and spaced apart from the distal upper end face in the transverse direction. The upper peripheral part is fitted into the receiving chamber so that the upper peripheral part mates with the surrounding wall, with the distal upper end face abutting against the protrusion, and with the distal lower end face abutting against the shoulder. Each of the biasing members is sleeved on a respective one of the hollow posts, and has an upper end and a lower end. The upper end abuts against the press member, whereas the lower end abuts against the base member. Each of the first screw fasteners extends through a respective one of the second through holes, and engages threadedly a respective one of the hollow posts. Each of the second screw fasteners extends through a respective one of the third through holes, and engages threadedly a respective one of the screw holes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
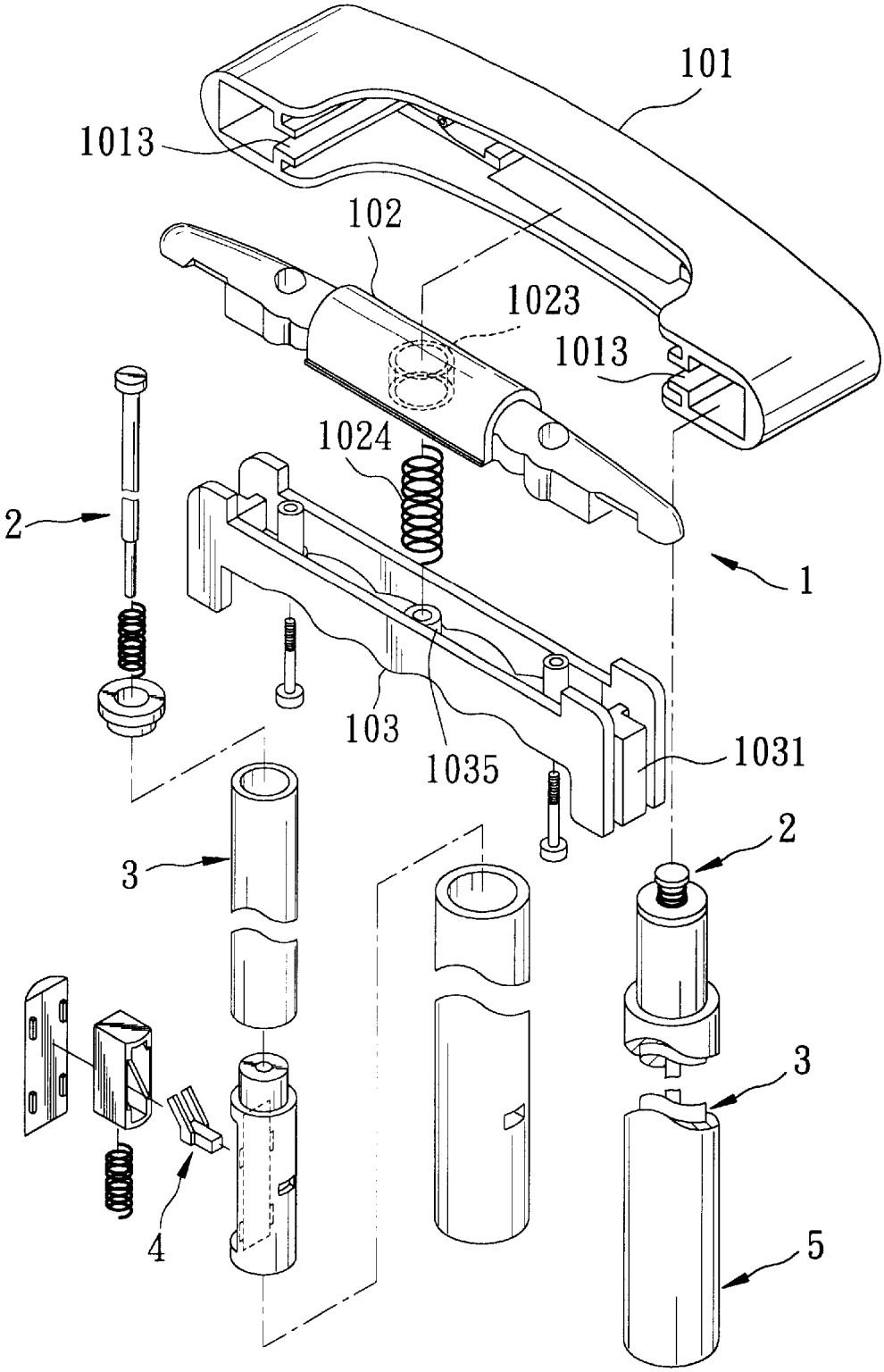
FIG. 1 PRIOR ART
FIG. 1 is an exploded perspective view of a conventional handle unit for a luggage case.
Figure 2:
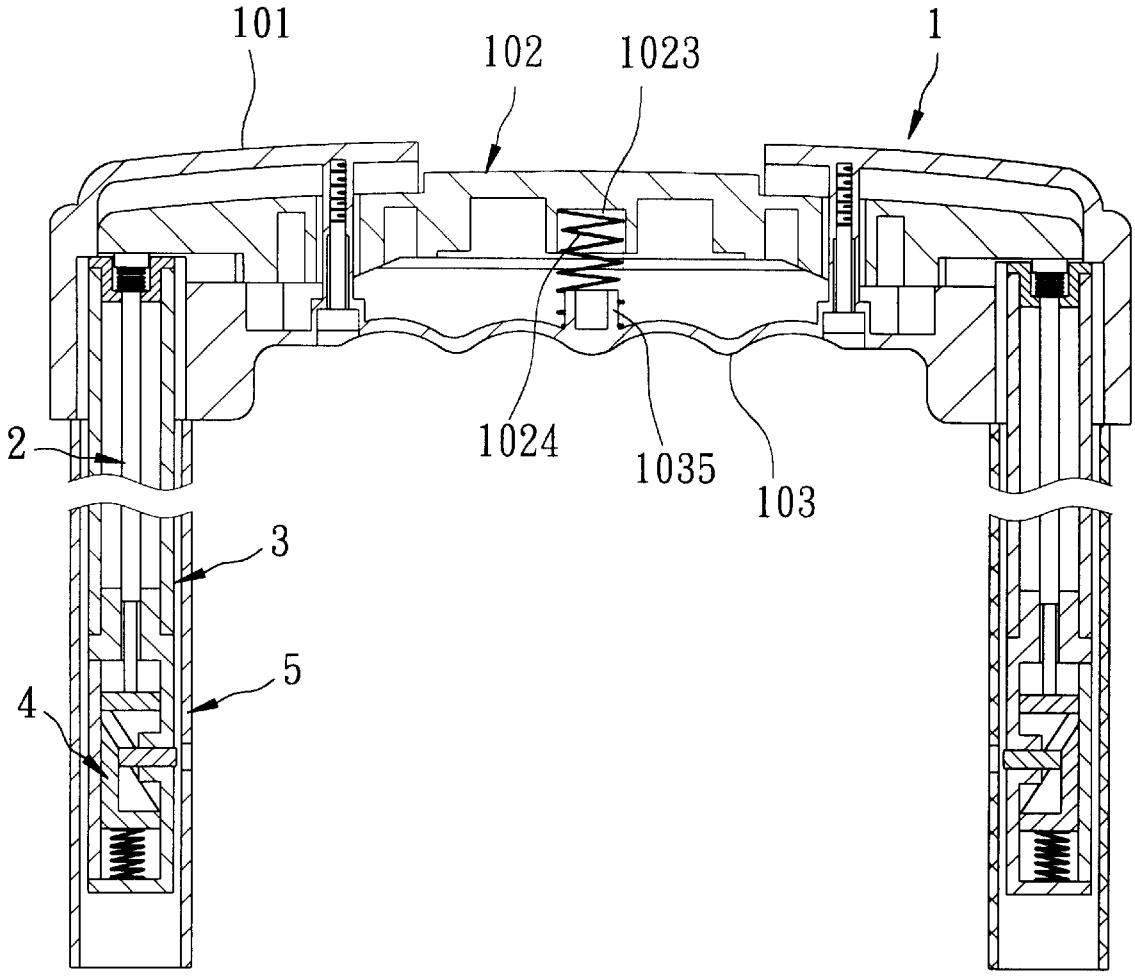
FIG. 2 PRIOR ART
FIG. 2 is a schematic cross-sectional view of the handle unit of FIG. 1 in an assembled state.
Figure 3:
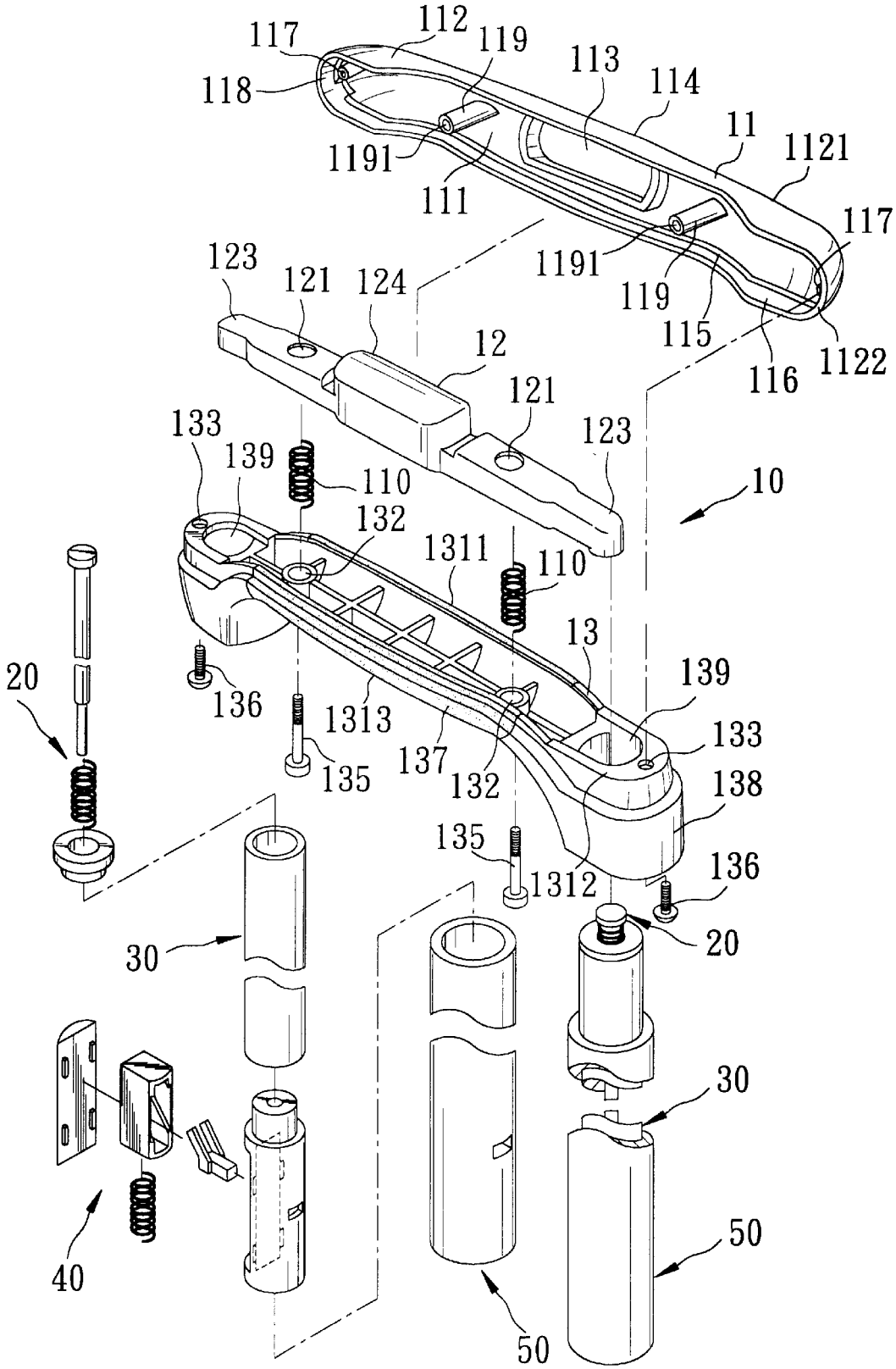
FIG. 3 is an exploded perspective view of the preferred embodiment of a handle unit according to the present invention.
Figure 4:
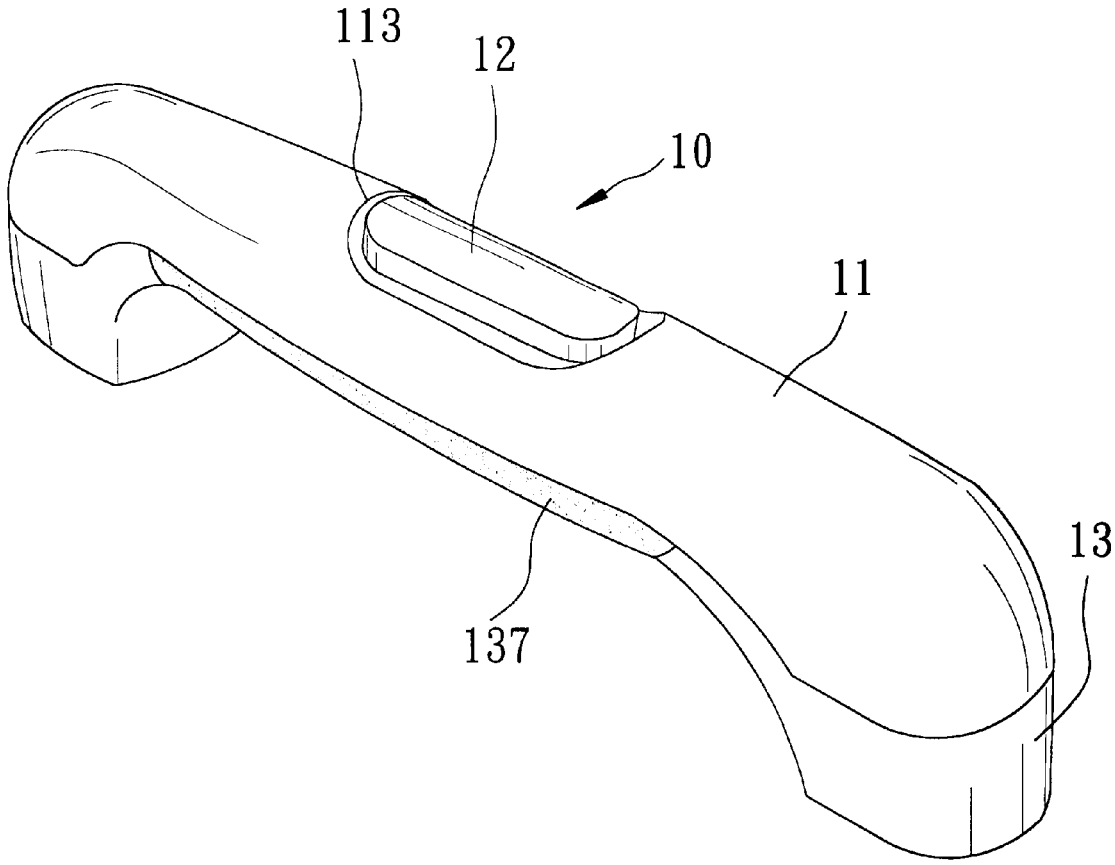
FIG. 4 is a perspective view of the handle unit of FIG. 3 in an assembled state.
Figure 5:
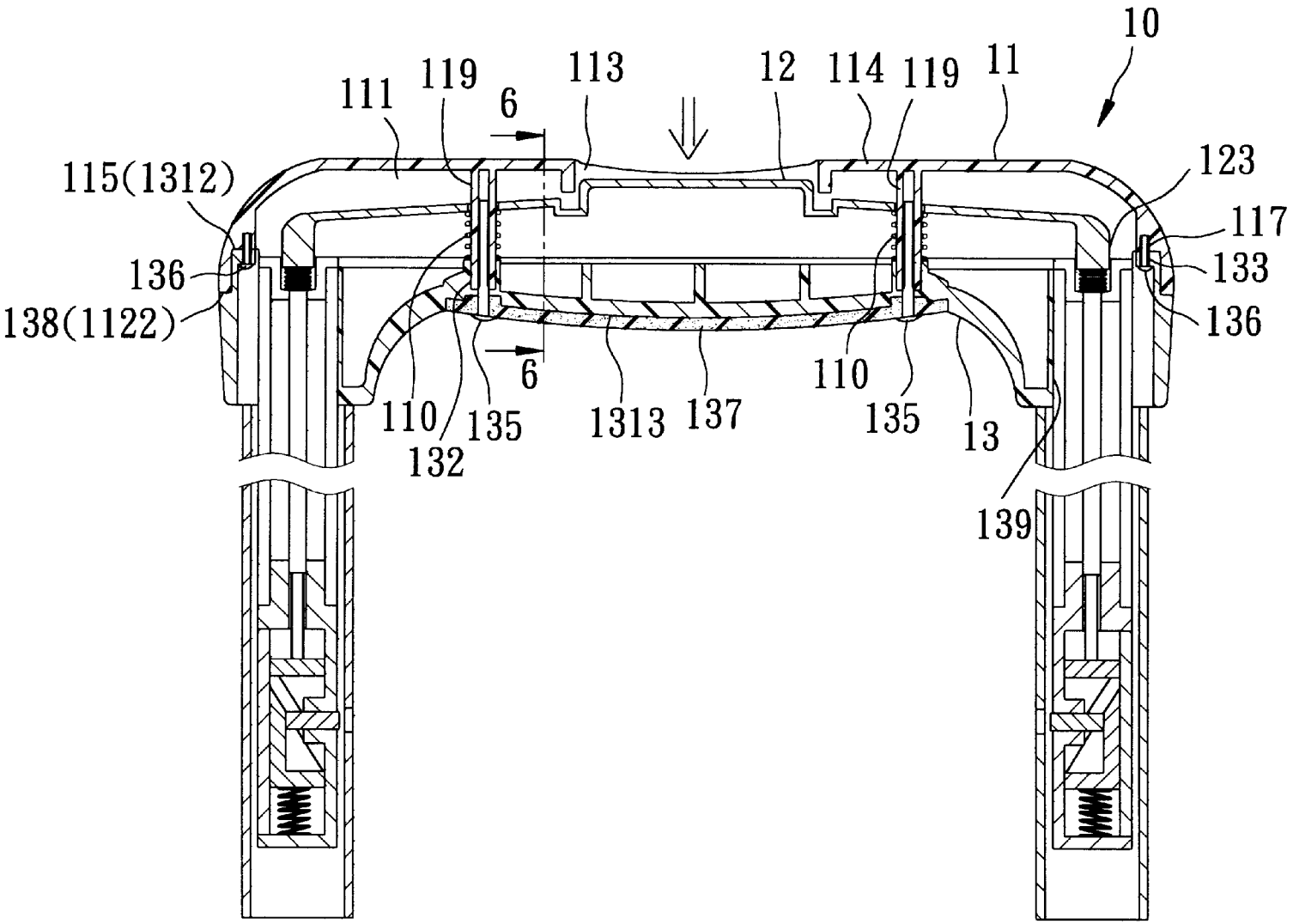
FIG. 5 is a schematic cross-sectional view of the handle unit of FIG. 3 in an assembled state.
Figure 6:
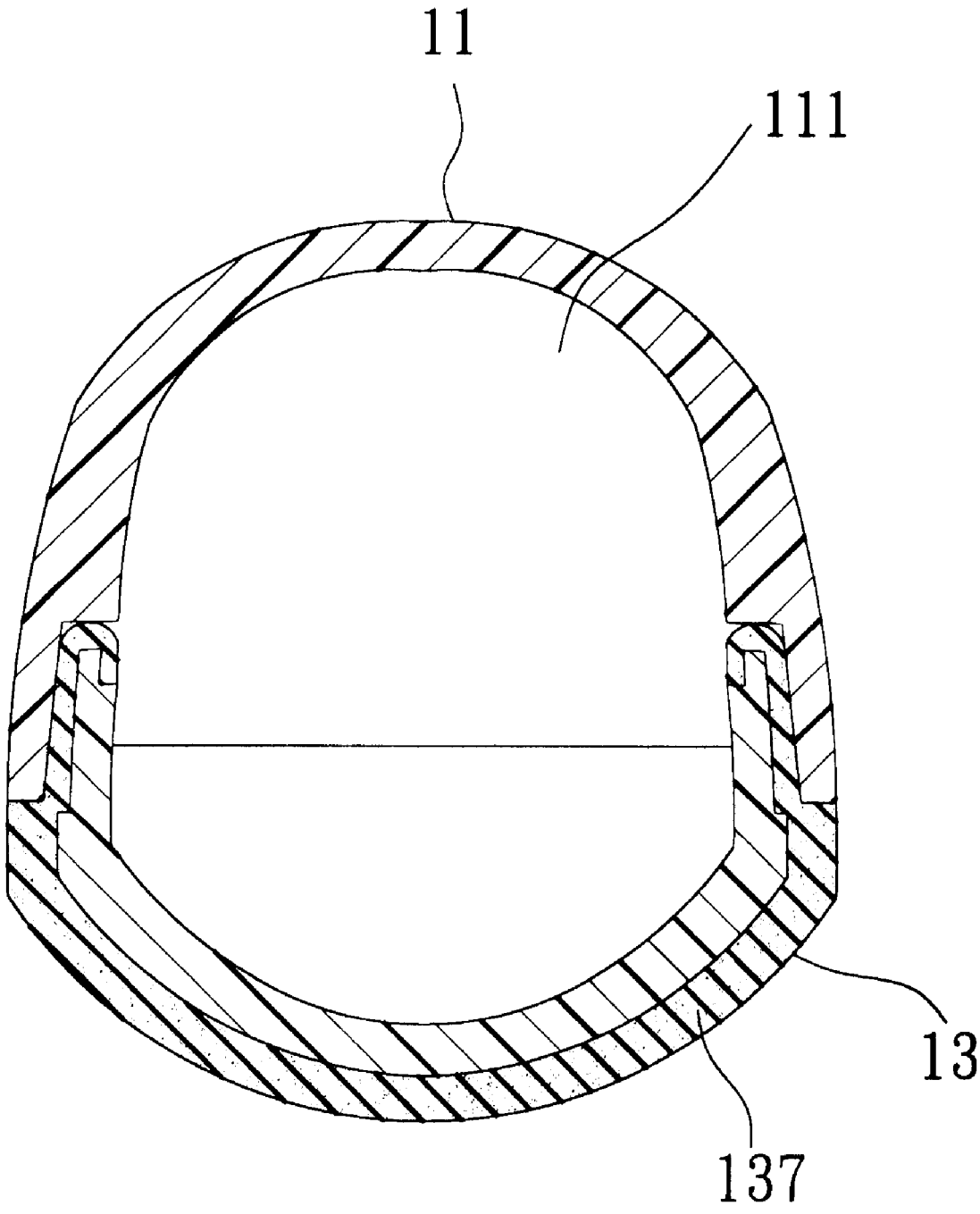
FIG. 6 is a schematic partly cross-sectional view of the preferred embodiment taken along line 6—6 in FIG. 5.

Referring to FIGS. 3 to 6, the preferred embodiment of a handle unit 10 according to the present invention is shown to be adapted for use in a retractable handle assembly of a luggage case. The handle assembly comprises the handle unit 10, two inner tubes 30, two linking rods 20, two locking devices 40, and two outer tubes 50. The handle unit 10 comprises an elongate upper cap member 11, an elongate press member 12, an elongate base member 13, a pair of biasing members 110, a pair of first screw fasteners 135, and a pair of second screw fasteners 136. The elongate upper cap member 11 has an upper wall 114 that extends in a longitudinal direction, and a surrounding wall 112 that extends from a periphery of the upper wall 114 in a transverse direction transverse to the longitudinal direction. The surrounding wall 112 cooperates with the upper wall 114 to form a downwardly opening receiving chamber 111. The upper wall 114 is formed with a cutout 113 and a pair of downwardly extending hollow posts 119 that are disposed at opposite sides of the cutout 113. The hollow posts 119 are spaced apart from each other in the longitudinal direction, and are formed with internal threaded holes 1191. The upper cap member 11 further has opposite longitudinal ends 118 formed with a respective screw hole 117 that opens downwardly. The surrounding wall 112 has a connecting end 1121 connected to the upper wall 114, a distal lower end face 1122 opposite to the connecting end 1121 in the transverse direction, and an inner wall surface 116 that is disposed between the connecting end 1121 and the distal lower end face 1122. The inner wall surface 116 is formed with a protrusion 115 that protrudes into the receiving chamber 111. In this embodiment, each of the screw holes 117 is formed in the protrusion 115.

The elongate press member 12 is disposed in the receiving chamber 111, and is formed with a pair of first through holes 121 and a pair of link actuating ends 123. Each of the first through holes 121 permits the hollow posts 119 to extend slidably and respectively therethrough. Each of the link actuating ends 123 extends toward the longitudinal ends 118 of the upper cap member 11, respectively. The elongate press member 12 further has a middle portion formed with an elongate protruding block 124 that projects into the cutout 113.

The elongate base member 13 is formed with a pair of second through holes 132, a pair of third through holes 133, and a pair of openings 139. The second through holes 132 are registered respectively with the threaded holes 1191 in the hollow posts 119. The third through holes 133 are registered respectively with the screw holes 117 in the upper cap member 11. The openings 139 extend in the transverse direction and permit access to the link actuating ends 123, respectively. The base member 13 has an upper peripheral part 1311 with a distal upper end face 1312, a peripheral shoulder 138 disposed around and spaced apart from the distal upper end face 1312 in the transverse direction, and a bottom side 1313 provided with a cushioning layer 137. Each of the third through holes 133 is formed through the distal upper end face 1312. The upper peripheral part 1311 is fitted into the receiving chamber 111 so that the upper peripheral part 1311 mates with the surrounding wall 112. As such, the distal upper end face 1312 abuts against the protrusion 115, whereas the distal lower end face 1122 abuts against the shoulder 138.

Each of the biasing members 110 is sleeved on a respective one of the hollow posts 119, and has an upper end and a lower end. The upper end abuts against the press member 12, whereas the lower end abuts against the base member 13. In this embodiment, each of the biasing members 110 is in the form of a coiled compression spring.

Each of the first screw fasteners 135 extends through a respective one of the second through holes 132, and engages threadedly the threaded hole 1191 in a respective one of the hollow posts 119.

Each of the second screw fasteners 136 extends through a respective one of the third through holes 133, and engages threadedly a respective one of the screw holes 117 in the protrusion 115 of the upper cap member 11.

During assembly of the handle unit 10, the press member 12 is inserted into the receiving chamber 111 of the upper cap member 11, the biasing members 110 are installed on the hollow posts 119, and the upper cap member 11 and the base member 13 are inter-engaged. At this time, the distal upper end face 1312 of the base member 13 abuts against the protrusion 115 of the upper cap member 11, whereas the distal lower end face 1122 of the upper cap member 11 abuts against the peripheral shoulder 138 of the base member 13. Preferably, the surrounding wall 112 of the upper cap member 11 and the base member 13 have outer wall surfaces that are flush with each other to result in a smooth contour. Finally, the first and second screw fasteners 135, 136 are respectively engaged within the threaded holes 1191 in the hollow posts 119 and the screw holes 117 in the protrusion 115 after extending through the second and third through holes 132, 133, respectively.

In use, each of the inner tubes 30 is extended into a respective one of the openings 139 and is fastened to the base member 13 in a known manner, such as via a fastening pin that extends from the base member 13 to the inner tube 30. At this time, the link actuating ends 123 are in contact with the linking rods 20 such that, when pressure is applied on the protruding block 124 in the cutout 113, the press member 12 moves downward against action of the biasing members 110 to activate the linking rods 20 for enabling the locking devices 40 to release engagement between the inner and outer tubes 30, 50 in a manner similar to that in the conventional handle structure described beforehand.

The handle unit 10 of the present invention is easy to assemble because of the direct fitting engagement between the peripheral part 1311 of the base member 13 and the receiving chamber 111 of the upper cap member 11. Furthermore, the presence of two biasing members 110 can help ensure balanced movement of the press member 12.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A handle unit for a retractable handle assembly of a luggage case, said handle unit comprising:

an elongate upper cap member having an upper wall that extends in a longitudinal direction, and a surrounding wall that extends from a periphery of said upper wall in a transverse direction transverse to the longitudinal direction and that cooperates with said upper wall to form a downwardly opening receiving chamber, said upper wall being formed with a cutout and a pair age of downwardly extending hollow posts that are disposed at opposite sides of said cutout, that are spaced apart from each other in the longitudinal direction, and that are threaded internally, said upper cap member further having opposite longitudinal ends formed with a respective screw hole that opens downwardly, said surrounding wall having a connecting end connected to said upper wall, a distal lower end face opposite to said connecting end in the transverse direction, and an inner wall surface formed with a protrusion that protrudes into said receiving chamber and that is disposed between said connecting end and said distal lower end face;

an elongate press member disposed in said receiving chamber and formed with a pair of first through holes that permit said hollow posts to extend slidably and respectively therethrough, and a pair of link actuating ends that extend toward said longitudinal ends of said upper cap member, respectively;

an elongate base member formed with a pair of second through holes that are registered respectively with said hollow posts, a pair of third through holes that are registered respectively with said screw holes, and a pair of openings that extend in the transverse direction and that permit access to said link actuating ends, respectively, said base member having an upper peripheral part with a distal upper end face and a peripheral shoulder disposed around and spaced apart from said distal upper end face in the transverse direction, said upper peripheral part being fitted into said receiving chamber such that said upper peripheral part mates with said surrounding wall, with said distal upper end face abutting against said protrusion and with said distal lower end face abutting against said shoulder;

a pair of biasing members, each of which is sleeved on a respective one of said hollow posts and has an upper end abutting against said press member, and a lower end abutting against said base member;

a pair of first screw fasteners, each of which extends through a respective one of said second through holes and engages threadedly a respective one of said hollow posts; and a pair of second screw fasteners, each of which extends through a respective one of said third through holes and engages threadedly a respective one of said screw holes.

2. The handle unit as claimed in claim 1, wherein each of said screw holes is formed in said protrusion, and each of said third through holes is formed through said distal upper end face.

3. The handle unit as claimed in claim 1, wherein each of said biasing members is a coiled compression spring.

4. The handle unit as claimed in claim 1, wherein said base member has a bottom side provided with a cushioning layer.

5. The handle unit as claimed in claim 1, wherein said elongate press member further has a middle portion formed with an elongate protruding block that projects into said cutout.

* * * * *